US010773916B2

(12) United States Patent
Rester et al.

(10) Patent No.: US 10,773,916 B2
(45) Date of Patent: Sep. 15, 2020

(54) SEGMENT ROLLER

(71) Applicant: Texmag GmbH Vertriebsgesellschaft, Thalwil (CH)

(72) Inventors: Bernd Rester, Achsheim (DE); Michael Spatz, Waldberg (DE)

(73) Assignee: Texmag GmbH Vertriebsgesellschaft, Thalwil (CH)

( * ) Notice: Subject to any disclaimer, the term of this patent is extended or adjusted under 35 U.S.C. 154(b) by 164 days.

(21) Appl. No.: 16/221,712

(22) Filed: Dec. 17, 2018

(65) Prior Publication Data

US 2019/0193976 A1 Jun. 27, 2019

(30) Foreign Application Priority Data

Dec. 22, 2017 (DE) ..... 10 2017 012 009

(51) Int. Cl.

| | |
|---|---|
| ***B65H 27/00*** | (2006.01) |
| ***D06B 23/02*** | (2006.01) |
| ***B65H 23/025*** | (2006.01) |
| ***D06C 3/06*** | (2006.01) |
| ***B65H 20/02*** | (2006.01) |

(52) U.S. Cl.

CPC ..... *B65H 27/00* (2013.01); *B65H 20/02* (2013.01); *B65H 23/0253* (2013.01); *D06B 23/023* (2013.01); *D06B 23/026* (2013.01); *D06C 3/06* (2013.01); *B65H 2404/1115* (2013.01); *B65H 2404/1141* (2013.01); *B65H 2601/522* (2013.01); *B65H 2601/524* (2013.01)

(58) Field of Classification Search

CPC ..... B65H 2404/1231; B65H 2404/133; B65H 2404/12; B65H 2404/55; B65H 2404/551; B65H 2404/5511; B65H 2404/5512; B65H 2404/5513; B65H 27/00; B65H 20/02

USPC ..... 492/36

See application file for complete search history.

(56) References Cited

U.S. PATENT DOCUMENTS

| | | | | |
|---|---|---|---|---|
| 202,992 A * | 4/1878 | Clark | B65H 27/00 492/40 |
| 307,448 A * | 11/1884 | Drown | D06C 3/06 26/100 |
| 669,444 A * | 3/1901 | Klitsch | F16H 55/38 474/185 |

(Continued)

FOREIGN PATENT DOCUMENTS

| | | |
|---|---|---|
| GB | 102111 | 2/1966 |

OTHER PUBLICATIONS

German Search Report for German patent application 10 2017 012 009.9, dated Nov. 5, 2018. 5 pages.

(Continued)

*Primary Examiner* — Jason L Vaughan

(74) *Attorney, Agent, or Firm* — Joseph E. Maenner; Maenner & Associates, LLC

(57) ABSTRACT

A segment roller (1) has a roller body (2), which is mounted rotatably about an axis (3). To this end, the roller body (2) has on the outside grooves (9), in which tongues (8) of profiles (7) engage. These profiles (7) grip the material web (5) directly or indirectly. In order to increase the working life and improve the mechanical properties of the profiles (7), the profiles (7) are of shear-resistant configuration and have elastic lips (20). These elastic lips (20) are deformed upon the engagement of the tongue (8) in the groove (9).

26 Claims, 2 Drawing Sheets

(56) References Cited

U.S. PATENT DOCUMENTS 678,121 A * 7/1901 Lewis ..... B65H 23/038 226/19
918,465 A * 4/1909 McCarty ..... B30B 3/005 101/375
2,339,557 A * 1/1944 Runals ..... D21F 5/00 34/115
2,356,026 A * 8/1944 Berry ..... D01D 10/0436 68/212
2,752,151 A * 6/1956 Levine ..... D06C 3/00 226/20
2,850,853 A * 9/1958 Simendinger ..... B24B 21/14 451/303
2,977,725 A * 4/1961 Simendinger ..... B24B 21/14 451/303
3,052,395 A * 9/1962 Scott ..... B65H 27/00 226/190
3,344,969 A * 10/1967 Collinge ..... B65G 39/071 26/106
3,637,122 A * 1/1972 Tokunaga ..... D06B 3/30 226/20
3,784,076 A * 1/1974 Avery ..... B65H 27/00 226/179
4,545,516 A * 10/1985 Miyai ..... B65H 23/038 226/20
4,646,403 A 3/1987 Nasu
5,244,138 A * 9/1993 Blanding ..... B65H 27/00 226/15
5,307,973 A * 5/1994 Schmidt ..... B65H 23/025 226/190
6,453,959 B1 * 9/2002 Johnson ..... B27B 25/02 144/246.1
6,550,656 B2 * 4/2003 Kurz ..... B65H 23/038 226/19
2011/0168752 A1 7/2011 Rester et al.

OTHER PUBLICATIONS

English translation of relevant portion of sections D2, D3, D4 of German Search Report for German patent application 10 2017 012 009.9.

* cited by examiner

SEGMENT ROLLER

CROSS-REFERENCE TO RELATED APPLICATION

The present application claims priority to German Patent Application no: 10 2017 012 009.9, filed Dec. 22, 2017, which is incorporated herein by reference in its entirety.

FIELD OF THE INVENTION

The invention relates to a segment roller, which has at least one roller body that is mounted rotatably about at least one axis. This roller body has on the outside at least one groove, in which at least one tongue of a profile displaceable along the length of the axis engages. This at least one profile here grips at least one material web directly or indirectly.

BACKGROUND OF THE INVENTION

From DE 1 460 639 A, a segment roller of the generic type is known. This consists of a roller body which is mounted rotatably about an axis. Formed on the outer side of this roller body are grooves, into which H-shaped profiles are inserted. These profiles are of elastic configuration and with their outer side clasp a material web. By displacement of the profiles, the material web can be stretched in width. This segment roller forms the basis of the present invention.

BRIEF SUMMARY OF THE INVENTION

The object of the invention is to provide a segment roller of the type stated in the introduction, which is distinguished by high accuracy in the influencing of the material web and a long working life.

This object is achieved with the following features. A segment roller according to the invention has at least one roller body, which is preferably made of a metal, in particular a metal alloy. This at least one roller body is preferably roughly cylindrical, wherein shapes which deviate herefrom could also be perfectly sensible. The at least one roller body is mounted rotatably about at least one axis, wherein the axis preferably coincides with a possibly present symmetrical axis of the at least one roller body. On at least one roller body is provided on the outside at least one groove, in which at least one tongue of at least one profile displaceable along the length of at least one axis engages. This at least one profile grips the at least one material web directly or indirectly. By the term "grip" should here not necessarily be understood a clasping of the at least one material web from both web sides. It is usually sufficient to clasp the at least one material web from one side. Hence the gripping can also be realized solely on one side. This is also in practical applications the norm. It has turned out that an elastic configuration of the at least one profile in accordance with the prior art presents considerable drawbacks. Usually, the position of the at least one profile can sensibly be influenced only by the end faces of the segment roller. Hence the position and a possible movement of the at least one profile are strictly speaking defined only at the end faces of the segment roller. Moreover, force equilibria in the at least one profile determine how this positions itself and moves. In this force equilibrium, in particular forces of the at least one material web play a crucial role, whereby the forces exerted on the at least one material web are in a certain region undefined. This results in a ragged and, in particular, poorly predictable influencing of the material web. For the solution of this problem, it is proposed to configure the at least one profile such that it is resistant to shear. Thus the entire at least one profile can be adjusted over its full length, in a defined manner, from the end faces of the segment roller. Each point on the at least one profile hence follows a control movement exercised by the end faces. The entire movement of the at least one profile is therefore defined and results in a clearly predictable and, in particular, reproducible force influence on the at least one material web. This has advantages both in the spreading and in the web path adjustment of the at least one material web, since the influencing of the at least one material web is realized in a reproducible and uniform manner. As a result of this measure, fatigue fractures in the at least one profile are prevented. The permanent pulling and pushing on the at least one profile gives rise to constant oscillatory movements, which in a known manner provoke fatigue fractures. In particular where a number of profiles are provided on the segment roller, the fracture tendency of the profiles is very disagreeable, since this results in very frequent repairs. Finally, it should be borne in mind that fractures of the at least one profile can lead to damaging of the at least one material web and to injuries to the operating staff. It is therefore desirable to suppress these effects as far as possible. Through the use of at least one dimensionally stable profile, a satisfactory solution to this problem is obtained. However, a dimensionally stable profile has the drawback that its usability is considerably reduced. The at least one profile must be displaceable along the length of the at least one axis in order to obtain the desired control effect. This displaceability requires, however, a certain clearance between the at least one groove and the at least one tongue. However, this clearance leads to transverse movements, in particular during the movement of the at least one profile along the length of the at least one axis. Thus the at least one tongue frequently collides in the at east one groove, which can lead to a braking of this movement. Moreover, this impacting generates in the at least one profile undesirable vibrations, which prevent sensitive influencing of the at least one material web. Furthermore, these impacts lead to undesirable noises and, in turn, to a shortening of the working life. In order to reduce the undesirable noises, as well as to avoid unwanted braking, ensure the sensitive influencing of the at least one material web and improve the working life of the segment roller, this is therefore not a suitable means. It is therefore additionally proposed to provide on the at least one roller body and/or on the at least one profile at least one sliding element with elastic lip, or at least one elastic lip with sliding function. This elastic lip is herein, upon the engagement of the at least one tongue in the at least one groove, elastically deformable. In this way, the at least one profile is held on the at least one roller body with little or no vibration in a sliding and secure, but also displaceable manner. This at least one elastic lip reduces the freedom of movement of the at least one profile transversely to the desired direction of displacement and prevents, in particular, the occurrence of impacts. Thus the generation of vibrations in the at least one profile is also prevented. In addition, the at least one sliding element with elastic lip or the at least one elastic lip with sliding function can also be used as tolerance compensation between the components. Only through the combination of these measures is, for example, the desired working life extension of the segment roller, along with, at the same time, sensitive influencing of the at least one material web, obtained.

For the simple manufacture of the segment roller, it is advantageous if the at least one lip is integrally connected to the at least one roller body or the at least one profile.

Preferably, the at least one lip is formed directly onto the at least one roller body or in the at least one profile, so that, for the creation of the at least one lip, no dedicated process step is necessary.

Alternatively, the at least one sliding element can be configured with elastic lip, or the at least one elastic lip also as a separate part which is plugged into the at least one groove or tongue. Thus, for the at least one separate part, a wide selection of materials is available, so that it can be produced from materials of choice. Preferably, the at least one separate part consists of a polymer, in order in this way to obtain sufficiently good elastic properties for the at least one sliding element with elastic lip or for the at least one elastic lip.

In order to hold the at least one separate part securely and, in particular, captively, it is expedient to configure the at least one groove or tongue in undercut form. If this undercut is sufficiently large, a positive-locking securement of the at least one separate part is obtained. The fitting is in this case preferably realized by insertion in the longitudinal direction.

In order to obtain a secure connection between the at least one profile and the at least one roller body, it is expedient if the at least one tongue is clasped on both sides by the lips.

In particular where lips arranged on both sides of the at least one tongue are used, it is advantageous if to the at least one lip is assigned at least one spacer. This at least one spacer prevents an undefined mobility of the at least one tongue in the at least one groove and in this way ensures an additional stabilization of the at least one profile. In addition, this spacer also offers a sliding function for the at least one profile.

Preferably, the at least one spacer is configured such that it is elastically adjustable. In this way, a certain elastic compliance is obtained, even if the at least one tongue is already touching the at least one spacer. In particular, it is envisaged to make the at least one spacer more rigid in relation to the at least one lip, so that, in the interaction between the at least one lip and the at least one spacer, a progressive resilience is obtained.

In principle, the at least one lip could be produced from a suitable, elastic material. It is easier, however, to configure the at least one lip with thin walls in relation to the at least one profile. Both parts can thus be made of the same material. The elasticity of the at least one lip in relation to the rest of the at least one profile is then obtained solely by the shaping, since thin-walled parts are more easily deformable than thick-walled parts.

In particular where used in the wet region of the at least one material web, it is advantageous if the at least one lip establishes a liquid-tight connection. The penetration of liquids into the at least one groove is thereby prevented, which, in particular in the change of material web type, could lead to problems.

In order to obtain a good sliding effect for the at least one profile, it is advantageous if the at least one lip is configured as a sliding part. In this way, a low-friction displaceability of the at least one profile is obtained.

In order to obtain universal usability of the segment roller, it is advantageous if in the at least one profile is held at least one covering, which clasps the at least one material web. The at least one covering can thus be adapted to the specific material web type without exchanging the complete at least one profile. In this case, it is sufficient to merely exchange the covering.

In order to hold the at least one profile with little vibration on the at least one roller body, it is finally favourable if the at least one profile is held at both ends in the grooves. A positive-locking seat of the at least one profile, in particular in relation to radially acting forces, is thereby obtained.

Finally, it is favourable to provide on the outside of the at least one roller body, in the region of the at least one groove, at least one protective boss. This at least one protective boss prevents damage to the groove cheeks, both in the fitting of the segment roller and during operation. In particular, damage to the at least one groove due to external force effect is hereby reduced.

BRIEF DESCRIPTION OF DRAWINGS

Other advantages and characteristics of this invention will be explained in the detailed description below with reference to the associated figures that contain several embodiments of this invention. It should however be understood, that the figure is just used to illustrate the invention and does not limit the scope of protection of the invention.

DETAILED DESCRIPTION OF THE INVENTION

Figure 1:
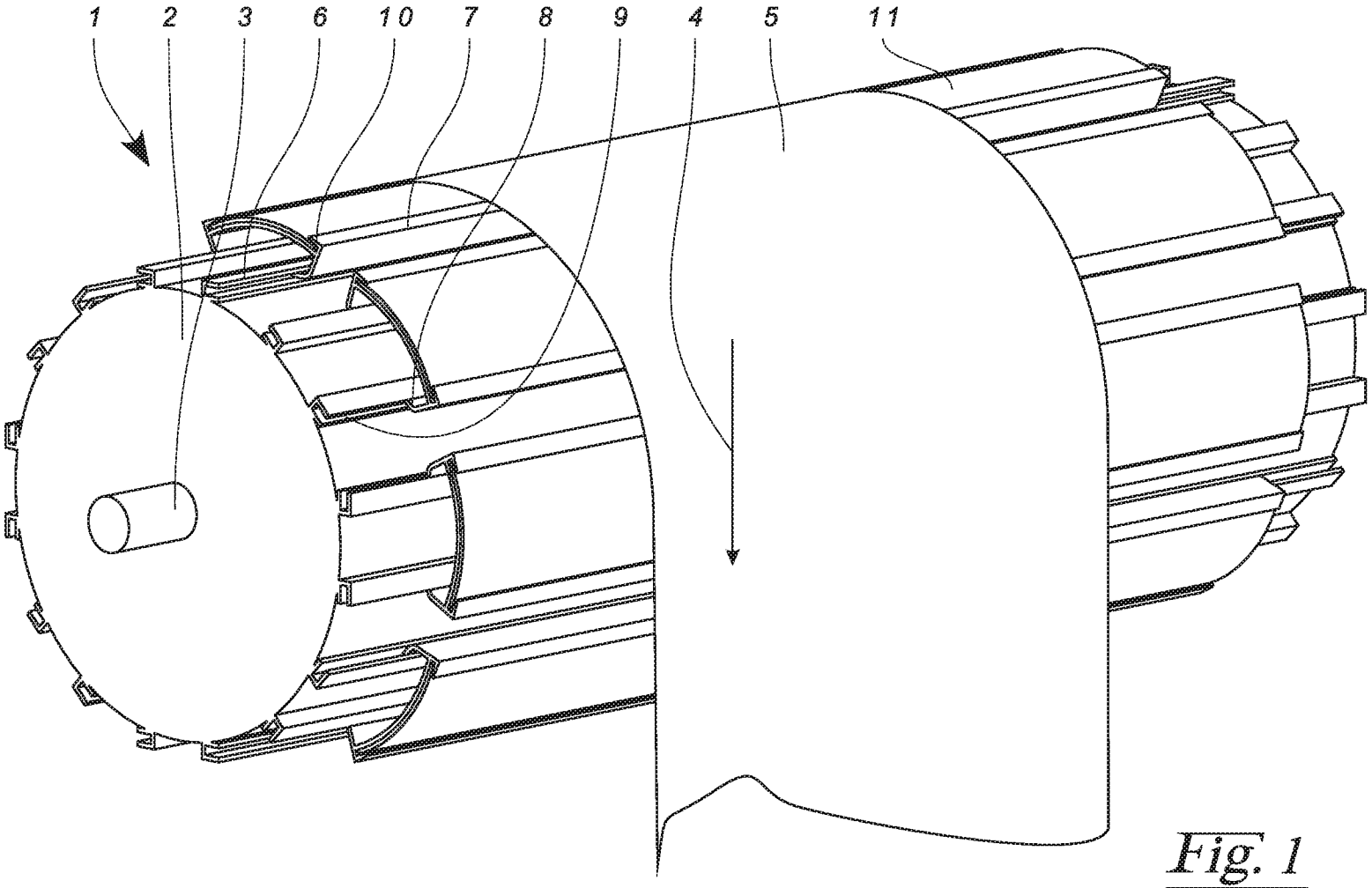
FIG. 1 shows a spatial representation of a segment roller.

FIG. 1 shows a segment roller 1, which is substantially formed of a roller body 2. This roller body 2 is supported rotatably about an axis 3 in order that the segment roller 1 can clasp a material web 5 running in the running direction 4. The material web 5 is here guided onto the segment roller 1, so that the material web 5, on the basis of its own tension force, presses with a certain force against the segment roller 1.

The roller body 2 has on its outer periphery slat holders 6, which are integrally formed onto the roller body 2. On these slat holders 6, profiles 7 are held displaceably along the length of the axis 3. These profiles 7 are controlled via control means (not represented) on the end faces of the segment roller 1, in order that these, during a revolution of the segment roller 1, perform a rotationally synchronous sliding movement. This sliding movement is then transmitted to the material web 5 in order to have a desired effect on the material web 5. In this way, the material web 5, for example, can be altered in terms of its position and/or spread. In this case, the profiles 7 themselves can also be symmetrically or asymmetrically divided over their length. This division is required, for example, in connection with a spreading of the material web 5.

To this end, the profiles 7 have tongues 8, which are held in grooves 9 of the slat holders 6. Via this connection, the profiles 7 are displaceable in the axial direction, yet firmly, in particular positively, held transversely thereto.

In order to be able to adapt the segment roller 1 beforehand to different material webs 5, on the profile 7 is provided a receptacle 10, in which a covering 11 can be inserted. This covering 11 is then specially adapted to the properties of the respective material web. Upon the changeover of different material webs 5 within a processing machine, the segment roller 1, furthermore, can also be adapted to the new tasks by simple changing of the coverings 11. In further applications, the material web 5 can also be clasped directly by the profile 7.

Both the roller body 2 and the profiles 7 are made of metal. In particular, aluminium and alloys thereof have proved successful for the roller body 2. These can be produced relatively easily in a continuous casting or extrusion process with any chosen length and constant cross section. In this way, a very cost-effective and thus economical manufacture of the roller body 2 is obtained. For the profiles 7, other materials too, in particular ferrous metals, are expedient, in order to achieve a high strength in spite of a thin-walled configuration.

Figure 2:
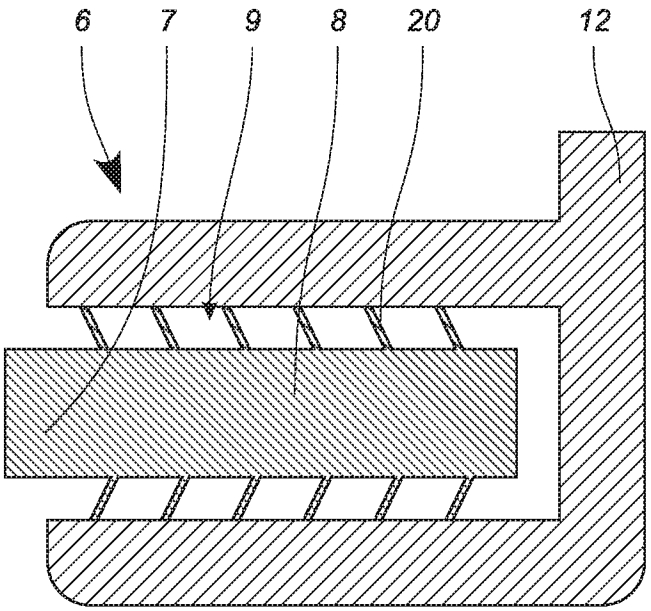
FIG. 2 shows a cross-sectional representation of the segment roller according to FIG. 1.

The further description is made with reference to the detailed drawing according to FIG. 2, which in enlarged view shows the slat holders 6 with the tongue 8 and the groove 9 in sectional representation.

On the outside of the slat holder 6 is provided a protective boss 12, which protects the groove 9 from damage. This protective boss 12 has a substantially rectangular cross section and radially overhangs the likewise radially oriented groove wall.

In order to prevent the tongue 8 from colliding, for example, in the groove 9, the tongue 8 of the profile 7 has elastic lips 20. These elastic lips 20 are integrally formed onto the tongue 8 and are configured with substantially thinner walls than the tongue 8. Alternatively, the elastic lips 20 could also be integrally formed onto the groove 9. Due to this thin-walled characteristic, an enhanced flexibility is obtained, so that the material of the profile 7, in the region of the lips 20, is elastically deformable. Preferably, the lips 20 are produced by cold forming of the profile 7. In particular where a non-ferrous metal is used for the profile 7, the lips 20 can also be produced in a single operation with the entire profiling of the profile 7, for instance after the extrusion process.

The lips 20 prevent collision of the tongue 8 in the groove 9 and hence, for example, braking upon a mutual relative movement of both parts. In this way, vibrations of the profile 7 are reliably prevented, and thus the accuracy of movement of the profile 7 improved. Moreover, the lips 20 prevent a penetration of liquid into the groove 9 when the material web 5 is used in the wet region.

Figure 3:
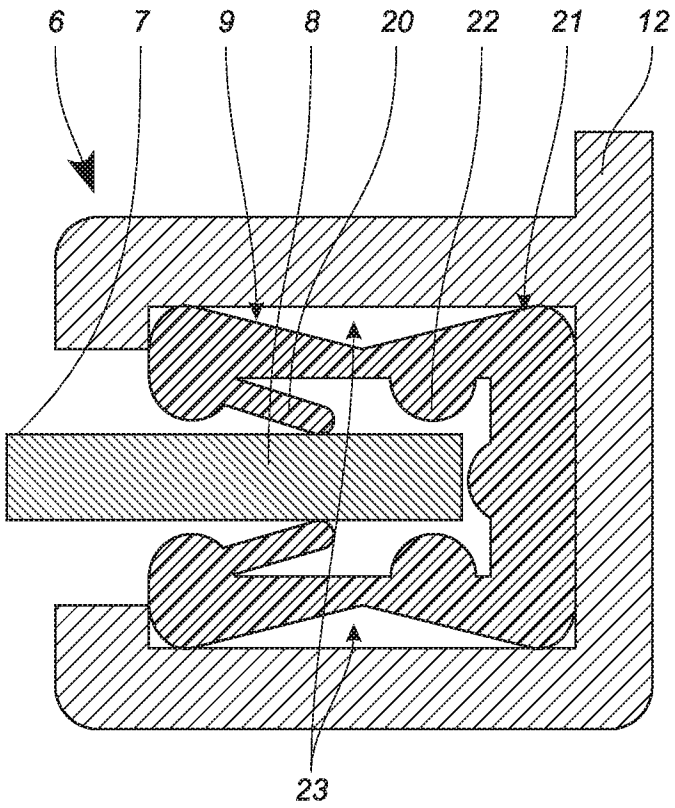
FIG. 3 shows the representation according to FIG. 2 of an alternative embodiment.

FIG. 3 shows a sectional representation according to FIG. 2 of an alternative embodiment of the segment roller. Same reference symbols here denote same parts. Below, only the differences from the embodiment according to FIG. 2 are examined.

In the embodiment according to FIG. 3, the sliding element with elastic lips 20 is provided or the elastic lips 20 with sliding function are provided in a separate part 21. This separate part 21 is preferably produced from a polymer, so that it is relatively easy to achieve the desired elastically deformable and sliding lips 20. The separate part 21 is here held positively in the groove 9. For this purpose, the groove 9 is configured in undercut form. This reliably prevents an accidental detachment of the separate part 21 from the roller body 2. In order to further restrict the mobility of the tongue 8 within the groove 9, in the separate part 21 additional spacers 22 are provided. These limit the displacement travel of the tongue 8 transversely to the axis 3, in addition these spacers 22 also have a sliding function. In this way, undefined positions of the tongue 8 within the groove 9 are prevented and a sliding action of the profile 7 is further maintained. Furthermore, this separate part 21 forms with the slat holder 6 cavities 23, which are compressed in the event of overload. In this way, the spacers 22 are elastically adjustable, so that, in this overload situation too, an elastic mounting of the tongue 8 is given. This resilience is, however, substantially stiffer than that of the lips 20, so that all in all a progressive resilience ensues. In this way, an additional damping effect, which prevents the formation of vibrations in the region of the material web 5, is obtained.

Since some of the embodiments of this invention are not shown or described, it should be understood that a great number of changes and modifications of these embodiments is conceivable without departing from the rationale and scope of protection of the invention as defined by the claims.

What is claimed is:

1. A segment roller has at least one profile, at least one axis having a length and at least one roller body that is mounted rotatably about said at least one axis, wherein said at least one roller body has an outside and at least one groove on said outside, said at least one profile has at least one tongue, being displaceable along said length of said at least one axis and engaging said at least one groove, said profile clasps at least one material web directly or indirectly, said at least one profile is of shear-resistant configuration, and on said at least one roller body is provided at least one elastic lip, which, upon the engagement of said at least one tongue in said at least one groove, said at least one tongue is elastically deformable in order to hold said at least one profile with little vibration in a displaceable manner.

2. The segment roller according to claim 1, wherein said at least one elastic lip is integrally connected to said at least one roller body.

3. The segment roller according to claim 1, wherein said at least one elastic lip is configured as a separate part and is plugged into said at least one groove.

4. The segment roller according to claim 3, wherein said at least one separate part is inserted into said at least one groove or tongue, and which at least one groove or tongue is configured in undercut form.

5. The segment roller according to claim 1, wherein said at least one tongue is clasped on both sides by said lips.

6. The segment roller according to claim 1, wherein said at least one elastic lip is assigned at least one spacer.

7. The segment roller according to claim 6, wherein said at least one spacer is elastically adjustable.

8. The segment roller according to claim 1, wherein said at least one elastic lip has a thin-walled configuration in relation to said at least one profile or the groove.

9. The segment roller according to claim 1, wherein said at least one elastic lip establishes a liquid-tight connection.

10. The segment roller according to claim 1, wherein said at least one elastic lip is configured as a sliding part.

11. The segment roller according to claim 1, wherein said at least one profile is held by at least one covering, which clasps the at least one material web.

12. The segment roller according to claim 1, wherein said at least one profile is held at both ends in said grooves.

13. The segment roller according to claim 1, wherein on said outside of said at least one roller body, in the region of said at least one groove, is provided at least one protective boss.

14. A segment roller has at least one profile, at least one axis having a length and at least one roller body that is mounted rotatably about said at least one axis, wherein said at least one roller body has an outside and at least one groove on said outside, said at least one profile has at least one tongue, being displaceable along said length of said at least one axis and engaging said at least one groove, said at least one profile clasps at least one material web directly or indirectly, said at least one profile is of shear-resistant configuration, and on said at least one roller body is provided at least one elastic lip, which, upon the engagement of said at least one tongue in said at least one profile, said at least one tongue is elastically deformable in order to hold said at least one profile with little vibration in a displaceable manner.

15. The segment roller according to claim 14, wherein said at least one elastic lip is integrally connected to said at least one profile.

16. The segment roller according to claim 14, wherein said at least one elastic lip is configured as a separate part and is plugged into said at least one tongue.

17. The segment roller according to claim 16, wherein said at least one separate part is inserted into said at least one groove or tongue, and which at least one groove or tongue is configured in undercut form.

18. The segment roller according to claim 14, wherein said elastic lip comprises two elastic lips and wherein said at least one tongue is clasped on both sides by said two elastic lips.

19. The segment roller according to claim 14, wherein said at least one elastic lip is assigned at least one spacer.

20. The segment roller according to claim 19, wherein said at least one spacer is elastically adjustable.

21. The segment roller according to claim 14, wherein said at least one elastic lip has a thin-walled configuration in relation to said at least one profile or the groove.

22. The segment roller according to claim 14, wherein said at least one elastic lip establishes a liquid-tight connection.

23. The segment roller according to claim 14, wherein said at least one elastic lip is configured as a sliding part.

24. The segment roller according to claim 14, wherein said at least one profile is held at least one covering, which clasps the at least one material web.

25. The segment roller according to claim 4, wherein said at least one profile is held at both ends in said grooves.

26. The segment roller according to claim 14, wherein on said outside of said at least one roller body, in the region of said at least one groove, is provided at least one protective boss.

* * * * *